United States Patent [19]

Becker et al.

[11] 4,283,299

[45] Aug. 11, 1981

[54] PRODUCTION OF DETERGENT COMPOSITIONS

[75] Inventors: Gert Becker, Weinheim; Johann U. Oesch, Hockenheim; Horst Poeselt, Bensheim, all of Fed. Rep. of Germany; Alan D. Tomlinson, Vlaardingen, Netherlands; Kurt Walz, Hockenheim, Fed. Rep. of Germany

[73] Assignee: Lever Brothers Company, New York, N.Y.

[21] Appl. No.: 80,845

[22] Filed: Oct. 1, 1979

[30] Foreign Application Priority Data

Oct. 3, 1978 [GB] United Kingdom ..... 39074/78

[51] Int. Cl.[3] ..... C11D 3/06; C11D 11/0; C11D 11/02; C11D 17/06

[52] U.S. Cl. ..... 252/90; 8/137; 252/109; 252/135; 252/156; 252/174; 252/174.24; 252/539; 252/540

[58] Field of Search ..... 252/90, 109, 135, 156, 252/174, 174.24, 539, 540; 8/137

[56] References Cited

U.S. PATENT DOCUMENTS

| | | | |
|---|---|---|---|
| 3,001,945 | 9/1961 | Drew | 252/547 |
| 3,056,652 | 10/1962 | Ryer | 252/135 X |
| 3,063,801 | 11/1962 | Groves | 252/135 |
| 3,868,336 | 2/1975 | Mazzola . | |
| 4,115,307 | 9/1978 | McGilvery | 252/135 |
| 4,131,558 | 12/1976 | Bailey | 252/135 |

FOREIGN PATENT DOCUMENTS

| | | | |
|---|---|---|---|
| 2605052 | 8/1976 | Fed. Rep. of Germany . | |
| 2637890 | 3/1977 | Fed. Rep. of Germany . | |
| 2816770 | 10/1978 | Fed. Rep. of Germany . | |
| 2322198 | 3/1977 | France | 252/135 |
| 1530799 | 11/1978 | United Kingdom | 252/135 |

*Primary Examiner*—Dennis L. Albrecht
*Attorney, Agent, or Firm*—Melvin H. Kurtz

[57] ABSTRACT

Particulate alkaline detergent compositions for fabric washing, which include synthetic detergent compounds and alkali metal tripolyphosphate and alkali metal orthophosphate detergency builders, are made by spray-drying a detergent base powder containing some or all of the detergent compounds and some or all of the orthophosphate and admixing at least 2.5% by weight of the tripolyphosphate in particulate form with the spray-dried base powder.

15 Claims, No Drawings

PRODUCTION OF DETERGENT COMPOSITIONS

The present invention relates to powdered detergent compositions which are adapted for fabric washing, and in particular to such compositions which are prepared by spray drying and contain synthetic detergent active compounds together with mixed phosphate detergency builders.

In our UK Pat. No. 1,530,799, we have described and claimed powdered alkaline fabric washing detergent compositions which essentially contain mixed alkali metal tripolyphosphate and alkali metal orthophosphate detergency builders in the ratio of from 10:1 to 1:5 parts by weight. These compositions were found to have surprisingly good detergency properties though containing lower levels of the phosphate detergency builders than in conventional sodium tripolyphosphate-based detergent compositions. This development enabled either a reduction in manufacturing cost because the difference in phosphate content could be made up with a cheaper filler, or an improvement in overall detergency by adding extra bleach or other additive instead. Additionally, this development facilitated the achievement of decreased phosphorus levels in detergent products to meet present or expected legislation.

Products of the type described in our aforementioned patent have met with appreciable commercial success, especially as economy brands. However, one potential problem which has been found with the detergent compositions based on mixed alkali metal tripolyphosphate and orthophosphate builders, is the level of inorganic deposits or incrustations which are sometimes found on heater elements and to a lesser extent other surfaces in washing machines. We have now found that the level of such deposits can be substantially decreased by using a new process for making such detergent compositions.

According to the present invention, a process for the preparation of a particulate alkaline detergent composition which contains a detergent active compound or mixture thereof, an alkali metal tripolyphosphate and an alkali metal orthophosphate, comprises spray drying a detergent base powder containing some or all of the detergent active compound, some or all of the orthophosphate, and optionally some of the tripolyphosphate, and admixing at least 2.5% by weight of alkali metal tripolyphosphate in particulate form with the spray dried base powder.

Without wishing to be bound by any theory, it appears that the presence of any alkali metal pyrophosphate caused by degradation of the alkali metal tripolyphosphate during normal spray drying contributes particularly to inorganic deposits on the washing machines. By postdosing some or all of the alkali metal tripolyphosphate, such degradation is decreased and hence the content of alkali metal pyrophosphate in the composition is decreased. Although some pyrophosphate also appears to be formed by hydrolysis of the alkali metal tripolyphosphate during the washing process itself, it appears that this does not contribute so significantly to inorganic deposits on the washing machines. Additionally, use of the process of the invention can give some detergent compositions a decreased tendency to form inorganic deposits on washed fabric under adverse washing conditions.

Although the process of the present invention is concerned in general with the production of detergent compositions which contain both alkali metal tripolyphosphate and alkali metal orthophosphate as detergency builders, the process is of particular value in preparing compositions of the type described in our aforementioned UK Pat. No. 1,530,799.

The alkali metal tripolyphosphate used is preferably sodium tripolyphosphate, which is readily available and relatively cheap, but potassium tripolyphosphate can be used if desired. Preferably at least quarter, especially about half to all the tripolyphosphate should be admixed with the spray dried base powder, i.e. postdosed, because this gives a lower alkali metal pyrophosphate content. But this may not be practical because of plant restrictions or because of the harmful effect on powder properties of excluding the tripolyphosphate from the base powder, particularly when relatively low alkali metal orthophosphate levels are used. Some benefit can then be achieved, especially under adverse slurry-making and spray-drying conditions leading to high tripolyphosphate degradation, by postdosing amounts of the alkali metal tripolyphosphate as low as 2.5%, i.e. half the tripolyphosphate when the minimum recommended level is employed in the preferred compositions of UK Pat. No. 1,530,799.

The alkali metal tripolyphosphate which is postdosed should, of course, have a suitable particulate form for postdosing, that is to say it should have an appropriate particle size range and powder density for uniform mixing with the spray dried base powder, so as to appear similar and to avoid undue segregation from the finished product.

The alkali metal orthophosphate used is either potassium or preferably sodium orthophosphate, as the latter is cheaper and more readily available. Normally the trialkali metal salts are used, but orthophosphoric acid or the di- or mono-alkali metal salts, e.g. disodium hydrogen orthophosphate or monosodium dihydrogen orthophosphate, could be used if desired in the production of the compositions. In the latter event, other more alkaline salts should also be present to maintain a high pH in the end product, i.e. with full neutralisation to the trialkali metal orthophosphate salts. The use of a mixture of the monosodium dihydrogen and disodium hydrogen orthophosphates in the ratio of 1:2 to 2:3, especially about 1:2, is particularly advantageous, as such mixture (known as "kiln-feed") is made in the production of sodium tripolyphosphate and is readily available. It is preferred to have all the alkali metal orthophosphate present in the detergent base powder, i.e. by inclusion in the slurry and then spray dried, but part of the orthophosphate can be postdosed if desired, either separately or together with the alkali metal tripolyphosphate.

Both the alkali metal orthophosphate and the alkali metal tripolyphosphate can be used initially as the hydrated salts, for example as trisodium orthophosphate dodecahydrate and pentasodium tripolyphosphate hexahydrate or in anhydrous form. It is, however, preferred that the salts should be in hydrated form in the final composition, by hydration of any anydrous salt added to the detergent slurry during processing, and by hydration of the alkali metal tripolyphosphate prior to or after postdosing. The amounts of the salts used are calculated in anhydrous form.

The total amounts of alkali metal tripolyphosphate and alkali metal orthophosphate in the detergent compositions are chosen according to the overall phosphate detergency builder level which is desired in the detergent compositions or according to the maximum permitted phosphorus content. Normally the total alkali metal tripolyphosphate and alkali metal orthophosphate level is between about 10% and 40% by weight of the composition, with a minimum level of at least about 5% of the tripolyphosphate and 2% of the orthophosphate. Preferably there is an alkali metal tripolyphosphate content of from about 5% to about 30%, especially about 10% to 25%, and an alkali metal orthophosphate content of from about 2% to about 15%, especially about 3% to 10%, by weight of the product. The total amount of alkali metal tripolyphosphate and alkali metal orthophosphate is preferably from about 15% to about 25% by weight of the composition.

It is generally preferred to have amounts of the alkali metal tripolyphosphate and the alkali metal orthophosphate, within the ratios of from about 15:1 to about 1:5, especially about 10:1 to about 1:2 parts by weight, respectively, with an excess of the former being preferred. These ratios of alkali metal tripolyphosphate to alkali metal orthophosphate are especially suitable for detergent compositions used at relatively high product concentrations, i.e. about 0.3% to 0.8% by weight, and where relatively high levels of phosphates are allowed in the products, i.e. equivalent to about 4% to 7% P. However, for detergent compositions which are to be used at relatively low product concentrations, i.e. about 0.1% to 0.3%, or at particularly low phosphate levels, it may be desirable to increase the proportion of the alkali metal orthophosphate from about 2:1 to about 1:5 parts by weight.

The process of the invention is particularly beneficial in making compositions with higher ratios of alkali metal tripolyphosphate to orthophosphate of about 15:1 to about 2:1 parts by weight, preferably with about 15% to about 30% by weight of the former and about 2% to about 10% by weight of the latter. It appears that reduction of the level of pyrophosphate by postdosing some or all of the tripolyphosphate in accordance with the invention in such compositions markedly decreases their tendency to form inorganic deposits during washing.

It is preferable that the only phosphate detergency builders used to make the compositions of the invention should be the alkali metal tripolyphosphate and alkali metal orthophosphate. In particular, it is desirable to add no alkali metal, i.e. sodium or potassium, pyrophosphates to the compositions as they tend to increase inorganic deposition as mentioned above. However, some alkali metal pyrophosphate is generally present as an impurity in alkali metal tripolyphosphate and orthophosphate, and extra pyrophosphate is formed by hydrolysis of any sodium tripolyphosphate which may be present in the slurry if it is not all postdosed. Hence, total absence of alkali metal pyrophosphate is generally unattainable in the detergent compositions, but it is preferred to have not more than about 5%, especially not more than about 2.5% alkali metal pyrophosphate present, as at higher levels the amount of inorganic deposits on the washing machine parts become more noticeable.

The detergent compositions of the invention necessarily include from at least about 5% and normally up to about 30%, preferably about 10% to about 25%, by weight of a synthetic anionic, nonionic, amphoteric or zwitterionic detergent compound or mixture thereof. Many suitable detergent compounds are commercially available and are fully described in the literature, for example in "Surface Active Agents and Detergents", Volumes I and II, by Schwartz, Perry & Berch.

The preferred detergent compounds which can be used are synthetic anionic and nonionic compounds. The former are usually water soluble alkali metal salts of organic sulphates and sulphonates having alkyl radicals containing from about 8 to about 22 carbon atoms, the term alkyl being used to include the alkyl portion of higher acyl radicals. Examples of suitable synthetic anionic detergent compounds are sodium and potassium alkyl sulphates, especially those obtained by sulphating higher ($C_8$–$C_{18}$) alcohols produced for example from tallow or coconut oil; sodium and potassium alkyl ($C_9$–$C_{20}$) benzene sulphonates, particularly sodium linear secondary alkyl ($C_{10}$–$C_{15}$) benzene sulphonates; sodium alkyl glyceryl ether sulphates, especially those ethers of the higher alcohols derived from tallow or coconut oil and synthetic alcohols derived from petroleum; sodium coconut oil fatty acid monoglyceride sulphates and sulphonates; sodium and potassium salts or sulphuric acid esters of higher ($C_9$–$C_{18}$) fatty alcohol-alkylene oxide, particularly ethylene oxide, reaction products; the reaction products of fatty acids such as coconut fatty acids esterified with isethionic acid and neutralised with sodium hydroxide; sodium and potassium salts of fatty acid amides of methyl taurine; alkane monosulphonates such as those derived by reacting alphaolefins ($C_8$–$C_{20}$) with sodium bisulphate and those derived by reacting paraffins with $SO_2$ and $Cl_2$ and then hydrolising with a base to produce a random sulphonate; and olefin sulphonates, which term is used to describe the material made by reacting olefins, particularly $C_{10}$–$C_{20}$ alphaolefins, with $SO_3$ and then neutralising and hydrolysing the reaction product. The preferred anionic detergent compounds are sodium ($C_{11}$–$C_{15}$) alkyl benzene sulphonates and sodium ($C_{16}$–$C_{18}$) alkyl sulphates.

Examples of suitable nonionic detergent compounds which may be used include in particular the reaction products of alkylene oxides, usually ethylene oxide, with alkyl ($C_6$–$C_{22}$) phenols, generally 5 to 25 EO, i.e. 5 to 25 units of ethylene oxide per molecule; the condensation products of aliphatic ($C_8$–$C_{18}$) primary or secondary linear or branched alcohols with ethylene oxide, generally 6 to 30 EO, or with both ethylene oxide and propylene oxide, and products made by condensation of ethylene oxide with the reaction products of propylene oxide and ethylenediamine. Other so-called nonionic detergent compounds include long chain tertiary amine oxides, long chain tertiary phosphine oxides and dialkyl sulphoxides.

Mixtures of detergent compounds, for example mixed anionic or mixed anionic and nonionic compounds may be used in the detergent compositions, particularly in the latter case to provide controlled low sudsing properties. This is beneficial for compositions intended for use in suds-intolerant automatic washing machines. We have also found that the use of some nonionic detergent compounds in the compositions decreases the tendency of insoluble phosphate salts to deposit on the washed fabrics, especially when used in admixture with some soap as described below.

Amounts of amphoteric or zwitterionic detergent compounds can also be used in the compositions of the invention but this is not normally desired due to their relatively high cost. If any amphoteric or zwitterionic detergent compounds are used it is generally in small amounts in compositions based on the much more commonly used synthetic anionic and/or nonionic detergent compounds. For example, mixtures of amine oxides and ethoxylated nonionic detergent compounds can be used.

Soaps may also be present in the detergent compositions of the invention, but not as the sole detergent compounds. The soaps are particularly useful at low levels in binary and ternary mixtures, together with nonionic or mixed synthetic anionic and nonionic detergent compounds, which have low sudsing properties. The soaps which are used are the sodium, or less desirably potassium, salts of $C_{10}$–$C_{24}$ fatty acids. It is particularly preferred that the soaps should be based mainly on the longer chain fatty acids within this range, that is with at least half of the soaps having a carbon chain length of 16 or over. This is most conveniently accomplished by using soaps from natural sources such as tallow, palm oil or rapeseed oil, which can be hardened if desired, with lesser amounts of other shorter-chain soaps, prepared from nut oils such as coconut oil or palm kernel oil. The amount of such soaps can be varied between about 0.5% and about 25% by weight, with lower amounts of about 0.5% to about 5% being generally sufficient for lather control. Amounts of soap between about 2% and about 20%, especially between about 5% and about 15%, can be advantageously used to give a beneficial effect on detergency. The soap is most conveniently added in the spray dried powder, but can also be postdosed in granular form if desired.

Apart from the essential detergent compounds and detergency builders, the detergent compositions of the invention can contain any of the conventional additives in the amounts in which such materials are normally employed in fabric washing detergent compositions. Examples of these additives include lather boosters such as alkanolamides, particularly the monoethanolamides derived from palm kernel fatty acids and coconut fatty acids, lather depressants such as alkyl phosphates, waxes and silicones, anti-redeposition agents such as sodium carboxymethylcellulose and polyvinyl pyrrolidone, oxygen-releasing bleaching agents such as sodium perborate and sodium percarbonate, per-acid bleach precursors, chlorine-releasing bleaching agents such as trichloroisocyanuric acid and alkali metal salts of dichloroisocyanuric acid, fabric softening agents, inorganic salts such as sodium sulphate, sodium carbonate and magnesium silicate, and, usually present in very minor amounts, fluorescent agents, perfumes, enzymes such as proteases and amylases, germicides and colourants.

It is particularly beneficial to include in the detergent compositions an amount of sodium perborate, preferably between about 10% and 40%, for example about 15% to about 30%, by weight. It has been found that the bleaching action of sodium perborate is boosted under the highly alkaline conditions which also give optimum detergency building action for the alkali metal orthophosphate. Thus, it becomes possible to achieve improved bleaching properties by using the same levels of sodium perborate as normal; or decreased levels of sodium perborate can be used to give equal bleaching properties to those of conventional products with higher levels of perborate and sodium tripolyphosphate as the sole detergency builder. The latter option can also be used to further decrease the raw materials costs of the compositions, if a cheap filler is used in place of part of the sodium perborate.

It is desirable to include one or more antideposition agents in the detergent compositions of the invention, to decrease the tendency to form inorganic deposits on washed fabrics. The amount of any such antideposition agent is normally from about 0.1% to about 5% by weight, preferably from about 0.2% to about 2% by weight of the compositions. The preferred antidepression agents are homo- and co-polymers of acrylic acid or substituted acrylic acids, such as sodium polyacrylate, the sodium salt of copolymethacrylamide/acrylic acid and sodium poly-alpha-hydroxyacrylate, salts of copolymers of maleic anhydride with ethylene, acrylic acid vinylmethylether or styrene, especially 1:1 copolymers, and optionally with partial esterification of the carboxyl groups. Such mono- and co-polymers preferably have relatively low molecular weights, e.g. in the range of about 1,000 to 50,000. Other antideposition agents include the sodium salts of polymaleic acid and polyitaconic acid, phosphate esters of ethoxylated aliphatic alcohols, polyethylene glycol phosphate esters, and certain phosphonates such as sodium ethane-1-hydroxy-1,1-diphosphonate, sodium ethylenediamine tetramethylene phosphate, and sodium 2-phosphonobutane tricarboxylate. Mixtures of organic phosphonic acids or substituted acrylic acids or their salts with protective colloids such as gelatin may also be used. The most preferred antideposition agent is sodium polyacrylate having a MW of about 10,000 to 50,000, for example about 20,000 to 30,000.

It is also possible to include in the detergent compositions of the invention minor amounts, preferably not more than about 20% by weight, of other non-phosphate detergency builders, which may be either so-called precipitant builders or ion-exchange or sequestrant builders. This is of particular benefit where it is desired to increase detergency whilst using particularly low levels of the essential alkali metal tripolyphosphate and alkali metal orthophosphate builders, so as to achieve especially low phosphorus contents in the detergent compositions. Examples of such other detergency builders are amine carboxylates such as sodium nitrilotriacetate, sodium carbonate, sodium aluminosilicate ion-exchange materials such as zeolites A and X, sodium citrate and soap, which can function as a detergency builder, as discussed above. However, such other builder materials are not essential, and it is a particular benefit of using the mixed alkali metal tripolyphosphate and orthophosphate that satisfactory detergency properties can be achieved at lower total phosphate levels than hitherto considered necessary without other detergency builders.

It is also desirable to include in the compositions an amount of an alkali metal silicate, particularly sodium ortho-, meta- or preferably neutral or alkaline silicate. The presence of such alkali metal silicates at levels of at least about 1%, and preferably from about 5% to about 15% by weight of the compositions, is advantageous in decreasing the corrosion of metal parts in washing machines, besides giving processing benefits and generally improved powder properties. The more highly alkaline ortho- and meta-silicates would normally only be used at lower amounts within this range, in admixture with the neutral or alkaline silicates.

The compositions of the invention are required to be alkaline, but not too strongly alkaline as this could result in fabric damage and also be hazardous for domestic usage. In practice the compositions should give a pH of from 9 to 11 in use in aqueous wash solution. It is preferred in particular for domestic products to have a minimum pH of at least 9.25 and especially a pH of 9.5 or over, as lower pHs tend to be less effective for optimum detergency building, and a maximum pH of 10.5, as more highly alkaline products can be hazardous if misused. The pH is measured at the lowest normal usage concentration of 0.1% w/v of the product in water of 12° H. (Ca), (French permanent hardness, calcium only) at 50° C., so that a satisfactory degree of alkalinity can be assured in use at all normal product concentrations.

The pH of the detergent compositions in use is controlled by the amount of alkali metal orthophosphate and by other alkaline salts such as alkali metal silicate, sodium perborate and sodium carbonate present. The presence of such other alkaline salts, especially the alkali metal silicates, is particularly beneficial, because the alkalinity of the alkali metal orthophosphate is diminished in hard water due to precipitation of the calcium salt. The other ingredients in the alkaline detergent compositions of the invention should of course be chosen for alkaline stability, especially the pH-sensitive materials such as enzymes.

The detergent compositions of the invention should be in free-flowing powdered form after admixture of the spray dried base powder and the postdosed alkali metal tripolyphosphate. Spray drying of the detergent base powder can be accomplished using conventional equipment and process conditions. It is preferred, however, to use counter current spray drying in air at elevated temperatures of about 150° C. to about 400° C.

The invention is illustrated by the following Examples in which parts and percentages are by weight except where otherwise indicated.

EXAMPLE 1

A detergent composition was prepared by firstly spray drying an aqueous detergent slurry containing 40% water, to form a base powder containing the following ingredients:

| Ingredient | % (based on final product) |
|---|---|
| Sodium alkyl benzene sulphonate | 6.00 |
| Nonionic detergent (18 EO) | 0.50 |
| Nonionic detergent (12 EO) | 1.50 |
| Soap | 3.00 |
| Sodium orthophosphate | 6.00 |
| Sodium silicate ($Na_2O:SiO_2$, 1:2) | 10.00 |
| Sodium sulphate | 24.50 |
| Sodium carboxymethylcellulose | 1.00 |
| Water, fluorescent agent, stabilisers | 7.50 |

To this base powder the following powdered ingredients were added with mixing:

| | |
|---|---|
| Sodium tripolyphosphate | 16.00 |
| Sodium perborate . $4H_2O$ | 24.00 |

This product was evaluated for fabric washing properties and found to have about the same detergency as for a comparative product A having the same nominal formulation but in which the sodium tripolyphosphate was included in the original detergent slurry and spray dried. However, it was found that with the product made according to the invention, there was a significant decrease in the visible amount of inorganic deposits on the heater elements and to a lesser extent on other metal machine parts in the top-loading washing machines used. The washing tests were conducted using water of 22° German hardness at 40° C., 60° C. and 95° C. at product concentrations of 150 g prewash and 150 g main wash or 300 g main wash only, with naturally soiled wash loads in Siemens WA 4600 and AEG Turnette S machines. Specifically, the thickness of the deposits on the heater elements were found to be as follows (95° C. wash):

| No. of Wash Cycles | Example 1 thickness (mm) | Comparative Product A thickness (mm) |
|---|---|---|
| 5 | 0.0 | 0.20 |
| 10 | 0.0 | 0.25 |
| 15 | 0.05 | 0.35 |
| 25 | 0.20 | 0.60 |

EXAMPLE 2

The procedure of Example 1 was repeated to form a product of the following formulation:

| Ingredient | % |
|---|---|
| Sodium alkyl benzene sulphonate | 9.0 |
| Nonionic detergents[1] | 3.0 |
| Sodium $C_{16}$–$C_{18}$ alkyl phosphate[1] | 0.6 |
| Sodium orthophosphate | 8.0 |
| Magnesium silicate | 0.5 |
| Sodium silicate ($Na_2O:SiO_2$, 1:2) | 10.0 |
| Sodium carboxymethylcellulose | 1.0 |
| Sodium sulphate | 23.5 |
| Sodium tripolyphosphate[2] | 12.0 |
| Sodium perborate[2] | 24.0 |
| Water, fluorescent agent, preservative | 8.4 |

[1]The alkyl phosphate was mixed with 2% of the nonionic detergents.
[2]Mixed separately with spray dried base powder.

This product was found to have good physical properties and to perform satisfactorily for detergency in practical washing tests. In addition, it was found that there were less inorganic deposits on the washing machine heater elements when using this product made according to the invention, than with a comparative commercially available product B containing mixed sodium tripolyphosphate and sodium orthophosphate builders, but in which both the builders were included in the original detergent slurry. The test results below also showed that the inorganic deposits on the machine were approximately the same as for a conventional commercially available detergent powder C containing 35% of sodium tripolyphosphate, despite the much lower phosphate content of the product made according to the invention.

| Wash Cycle | Example 2 deposits (mm) | Product B deposits (mm) | Powder C deposits (mm) |
|---|---|---|---|
| 10 | 0 | 0.05 | 0 |
| 15 | 0.05 | 0.1 | 0 |
| 20 | 0.05 | 0.25 | 0 |

What is claimed is:

1. A process for preparing a particulate alkaline detergent composition which contains at least about 5% by weight of a synthetic detergent active compound or mixture thereof, at least about 5% of an alkali metal tripolyphosphate and about 3% to about 10% of an alkali metal orthophosphate with a total amount of the tripolyphosphate and orthophosphate of from about 15% to about 25% by weight and no more than 2.5% by weight of alkali metal pyrophosphate, comprising the steps of spray drying a detergent base powder containing some or all of the detergent active compound or compounds and some or all of the alkali metal orthophosphate, and admixing at least about 5% by weight of the alkali metal tripolyphosphate in particulate form with the spray dried base powder, with the remainder if any of the alkali metal tripolyphosphate being spray-dried in the base powder, the percentages being based on the total composition.

2. A process according to claim 1, wherein the alkali metal tripolyphosphate is sodium tripolyphosphate.

3. A process according to claim 1, wherein at least about half of the alkali metal tripolyphosphate is admixed with the spray dried base powder.

4. A process according to claim 1, wherein the alkali metal orthophosphate is monosodium dihydrogen orthophosphate, disodium monohydrogen orthophosphate or trisodium orthophosphate, or a mixture thereof.

5. A process according to claim 1, wherein not more than about 5% by weight of alkali metal pyrophosphate is present in the composition.

6. A process according to claim 1, wherein from about 2% to about 20% by weight of soap is incorporated in the composition.

7. A process according to claim 6, wherein the soap is added in the spray dried base powder.

8. A process according to any of the preceding claims, wherein from about 0.1% to about 5% by weight of an antideposition agent is incorporated into the composition.

9. A process according to claim 8, wherein the antideposition agent is a polymeric aliphatic carboxylate.

10. A process according to claim 8, wherein the antideposition agent is sodium polyacrylate.

11. A process according to claim 1 wherein from about 1% to about 15% by weight of alkali metal silicate is incorporated in the spray-dried base powder.

12. A process according to claim 1, wherein the resultant compositions give a pH from 9 to 11 in use in aqueous wash solution.

13. A process according to claim 1, wherein from about 10% to about 25% by weight of synthetic detergent compound is incorporated in the spray-dried base powder.

14. A process according to claim 1, wherein the ratio of said alkali metal tripolyphosphate to said alkali metal orthophosphate in the composition lies between about 15:1 and about 2:1 by weight.

15. A method of reducing inorganic deposits in washing machines comprising the steps of adding an effective amount of a particulate alkaline detergent composition to the washing machine to form a wash solution, washing fabrics in said wash solution and then draining the wash solution from the washing machine after the completion of the washing process; said particulate alkaline detergent composition containing at least about 5% by weight of a synthetic detergent active compound or mixture thereof, at least about 5% of an alkali metal tripolyphosphate; about 3% to about 10% of an alkali metal orthophosphate with a total amount of tripolyphosphate and orthophosphate of from about 15% to about 25% by weight and no more than 2.5% by weight of alkali metal pyrophosphate, comprising the steps of spray drying a detergent base powder containing some or all of the detergent active compound or compounds and some or all of the alkali metal orthophosphate, and admixing at least about 5% by weight of the alkali metal tripolyphosphate in particulate form with the spray dried base powder, with the remainder if any of the alkali metal tripolyphosphate being spray dried in the base powder, the percentages being based on the total composition.

* * * * *